US005782868A

United States Patent [19]

Moore, Jr. et al.

[11] Patent Number: 5,782,868

[45] Date of Patent: Jul. 21, 1998

[54] GEL FILLED TEETHING DEVICE

[76] Inventors: Cratus Dewayne Moore, Jr.; Kristi Lynn Moore, both of 17620 Cranbrook Rd., Edmond, Okla. 73003

[21] Appl. No.: 832,410

[22] Filed: Apr. 2, 1997

[51] Int. Cl.[6] ..... A61J 17/02

[52] U.S. Cl. ..... 606/235

[58] Field of Search ..... 606/235, 234, 606/236

[56] References Cited

U.S. PATENT DOCUMENTS

| | | | |
|---|---|---|---|
| 1,095,264 | 5/1914 | Bridges . | |
| 1,235,169 | 7/1917 | Tallon . | |
| 2,421,574 | 6/1947 | Newmark | 128/359 |
| 2,514,844 | 7/1950 | Cohen | 128/359 |
| 3,669,117 | 6/1972 | Herbst | 128/360 |
| 3,875,940 | 4/1975 | Beuther | 128/255 |
| 3,990,455 | 11/1976 | Panicci | 128/359 |
| 4,116,202 | 9/1978 | Panicci | 128/359 |
| 4,311,149 | 1/1982 | Panicci | 128/359 |
| 4,447,164 | 5/1984 | Berndt | 374/162 |
| 4,671,267 | 6/1987 | Stout | 128/156 |
| 4,950,286 | 8/1990 | Meussdoerffer | 606/236 |
| 5,013,321 | 5/1991 | MacVane | 606/234 |
| 5,160,344 | 11/1992 | Werton | 606/235 |
| 5,197,974 | 3/1993 | Scarpelli et al. | 606/235 |
| 5,211,656 | 5/1993 | Maddocks et al. | 606/236 |
| 5,606,871 | 3/1997 | Hansen et al. | 606/235 X |

*Primary Examiner*—Michael H. Thaler
*Attorney, Agent, or Firm*—Dunlap & Codding, P.C.

[57] ABSTRACT

An improved teething apparatus having a constant pliability over a broad temperature range whereby the pliability of the teething device remains substantially constant regardless of its temperature is provided. The teething device includes a resilient, fluid impervious body member sized to be received in a mouth of an infant. A body of self-sustaining, non-flowable, pliable gel is disposed in the interior cavity of the body member such that the body of gel substantially fills an interior cavity of the body member. The body of gel is characterized by the properties of maintaining the self-sustension and pliability over a temperature range of from about −20° to 215° F. whereby the body member and the body of gel can be heated or cooled over a temperature range of from about −20° to 215° F. without substantially altering the resilience of the body member and the pliability of the body of gel.

7 Claims, 2 Drawing Sheets

GEL FILLED TEETHING DEVICE

CROSS REFERENCE TO RELATED APPLICATIONS

Not applicable

STATEMENT REGARDING FEDERALLY SPONSORED RESEARCH OR DEVELPMENT

Not applicable

BACKGROUND OF THE INVENTION

1. Field of the Invention

The present invention relates generally to teething devices, and more particularly, but not by way of limitation, to an improved teething device filled with a gel having a constant pliability over a broad temperature range whereby the pliability of the teething device remains substantially constant regardless of its temperature.

2. Brief Description of the Related Art

Pacifiers, teething rings, and other types of teething devices have long been used to satisfy the sucking and chewing instincts of infants. However, during an infant's teething period, the infant's gums are often sore and inflamed and thus cause the infant considerable discomfort. To this end, many teething devices have been previously proposed for bringing about a reduction in the inflammation, and thus discomfort, to an infant's sore gums.

An example of such a device is disclosed in U.S. Pat. No. 5,197,974, issued to Scarpelli et al. Scarpelli et al. discloses a pacifier with a fluid filled nipple which enables the nipple to be selectively heated or chilled as desired for treating an infant's sore gums.

U.S. Pat. No. 3,669,117, issued to Herbst, discloses a combination pacifier and teether which is filled with a soft, compressible body of gel or liquid that can be cooled by placing the device in a refrigerator for selected time periods.

While many of the prior art teething devices, including those taught by the above mentioned patents, have achieved varying degrees of success, such devices are not capable of being heated or cooled over a broad temperature range without the resiliency of the teething device being altered. That is, the prior art teething devices are filled with fluids that become solid when subjected to temperatures at or below the freezing point of water. A non-resilient device may cause injury to an infant or the infant may refuse or reject the device due to the change in the consistency of the device. In contrast, when the devices are subjected to high temperatures, the viscosity of the fluid is increased and in turn the devices are much softer or pliable than experienced at room temperature. Again, the infant may have a tendency to refuse the teething device due to the change in the consistency of the device. To this end, a need exists for a teething device having a constant pliability over a broad temperature range whereby the pliability of the teething device remains substantially constant regardless of its temperature. It is to such an improved teething device that the present invention is directed.

BRIEF SUMMARY OF THE INVENTION

The present invention is directed to a teething device for an infant. The teething device includes a resilient, fluid impervious body member sized to be received in a mouth of an infant and provided with an interior cavity. A body of self-sustaining, non-flowable, pliable gel is disposed in the interior cavity of the body member such that the body of gel substantially fills the interior cavity. The body of gel is characterized by the properties of maintaining the self-sustension and pliability over a temperature range of from about −20° to 215° F. whereby the body member and the body of gel can be heated or cooled over a temperature range of from about −20° to 215° F. without substantially altering the resilience of the body member and the pliability of the body of gel.

In another aspect the present invention is directed to a method of manufacturing a teething device. The method includes the steps of (a) forming a resilient, fluid impervious body member having an interior cavity and sized to be received in a mouth of an infant; (b) forming a body of self-sustaining, non-flowable, pliable gel within the interior cavity of the body member such that the body of gel substantially fills the interior cavity, the body of gel being characterized by the properties of maintaining the self-sustension and pliability over a temperature range of from about −20° to 215° F. whereby the body member and the body of gel can be heated or cooled over a temperature range of from about −20° to 215° F. without substantially altering the resilience of the body member and the pliability of the body of gel; and (c) sealing the body of gel within the interior cavity of the body member.

Finally, the present invention is directed to a method of administering a thermal treatment within a mouth, comprising the steps of: (a) providing a resilient, fluid impervious body member sized to be received in the mouth and filled with a body of self-sustaining, non-flowable, pliable gel being characterized by the properties of maintaining the self-sustension and pliability over a temperature range of from about −20° to 215° F. whereby the body member and the body of gel can be heated or cooled over a temperature range of from about −20° to 215° F. without substantially altering the resilience of the body member and the pliability of the body of gel; (b) treating the body member and the body of gel by altering the temperature of the body member and the body of gel to a level significantly above or below body temperature while maintaining the pliability of the body member and the body of gel; and (c) introducing the body member into the mouth and applying the body member and placing the body member in close proximity to a selected portion of the mouth for heating or cooling of the selected portion.

The objects, features and advantages of the present invention will become apparent from the following detailed description when read in conjunction with the accompanying drawings and appended claims.

DETAILED DESCRIPTION OF THE INVENTION

Figure 1:
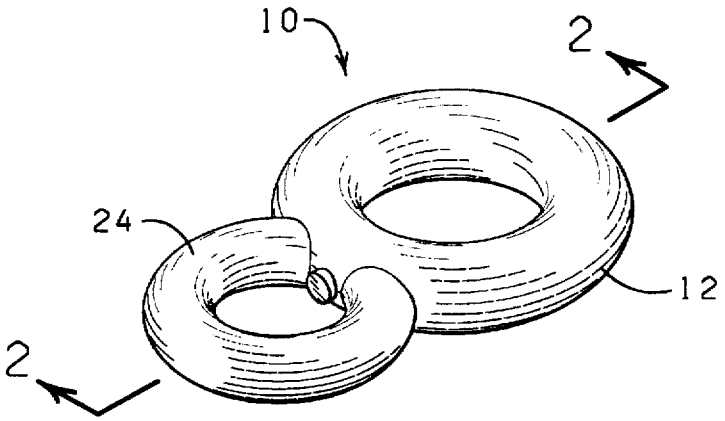
FIG. 1 is a perspective view of a teething ring constructed in accordance with the present invention.
Figure 2:
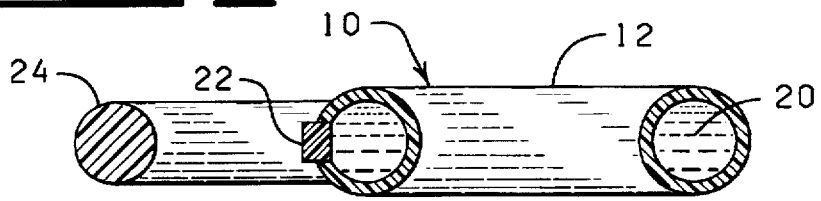
FIG. 2 is a cross-sectional view of the teething ring of the present invention taken along lines 2—2 of FIG. 1.
Figure 3:
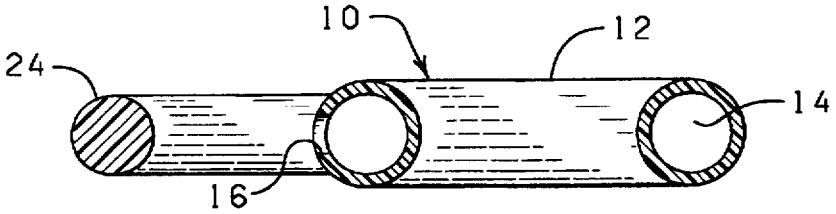
FIG. 3 is a cross-sectional view of the teething ring of the present invention shown with the plug and gel removed.

Referring now to the drawings and more particularly to FIGS. 1–3, a teething device 10 constructed in accordance with the present invention is illustrated. The teething device 10 shown in FIGS. 1–3 is commonly referred to as a teething ring in that the teething device 10 includes a ring-shaped body member 12. As shown in FIG. 3, the body member 12 is hollow so as to form an interior cavity 14, and the body member 12 is provided with an opening 16 for providing access to the interior cavity 14. The body member 12 is formed of a resilient, non-toxic, fluid impervious material, such as a foodgrade plasticized polyvinyl chloride or synthetic rubber, or the like, which maintains its resiliency over a temperature range of from about −20° F. to about 250° F.

The interior cavity 14 is filled with a pliable body of gel 20. The body of gel 20 is characterized by the property of maintaining its pliability over a relatively broad temperature range of from about −20° F. to 350° F. so that, in turn, the pliability of the teething device 10 remains substantially constant regardless of whether the teething device 10 is heated or cooled in order to effect an appropriate thermal treatment. The body of gel 20 is formulated from a water soluble humectant entrapped within a polymeric matrix. The humectant is selected from the group consisting of glycerin, ethylene glycol, dimethyl sulfoxide, and dimethyl formimide. In addition, the humectant is preferably present at a level of from about 20 to 85 percent by weight in the body of gel, and more preferably from about 50 to 75 percent by weight. The preferred polymeric matrix is selected from the group consisting of polymers, copolymers, and terpolymers containing acrylic acid or acrylamide monomer moieties, and most preferably is a polymer of acrylaide.

A variety of formulations can be employed in the formulation of the body of gel 20 to render the body of gel 20 suitable for incorporation into the teething device 10 of the present invention. Such formulations are more specifically disclosed in U.S. Pat. No. 4,671,267, issued to Edward I. Stout, which is hereby incorporated by reference.

To inject the gel into the body member 12, the constituent materials of the gel are admixed at a temperature between 65° to 80° F. so that the mixture is in a liquid state. The liquid mixture is injected into the interior cavity 14 of the body member 12 via the opening 16 whereupon the liquid mixture is allowed to set for a period of at least one-half hour, and more preferably for about twenty-four hours until the gel is in the form of a pliable, self-sustaining body of gel. The body of gel 20 is then sealed within the interior cavity 14 of the body member 12 by inserting a plasticized plug 22 in the opening 16, and thereafter securing the plug 22 in the opening 16 with a non-toxic adhesive, by sonic welding, heat fusion, radio frequency or the like.

To facilitate an infant holding the teething device 10, the teething device 10 is provided with a handle 24 secured to a portion of the body member 12. The handle 24 is preferably made of a rigid plastic material such that the teething device 10 can be comfortably held by an individual upon heating or cooling the body member 12 and the body of gel 20.

Figure 4:
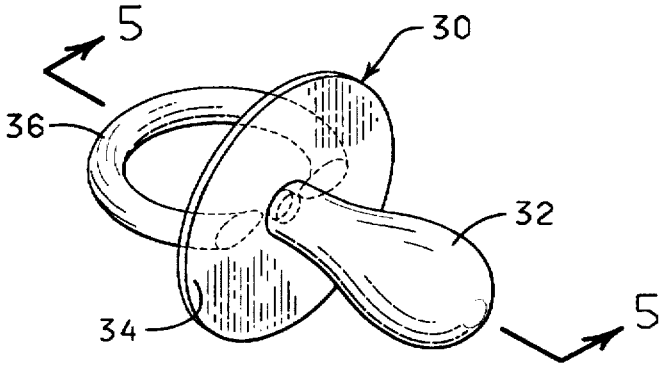
FIG. 4 is a perspective view of a pacifier constructed in accordance with the present invention.
Figure 5:
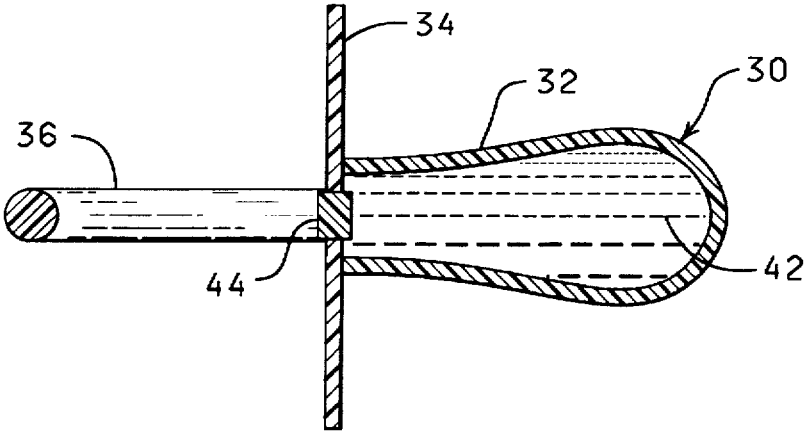
FIG. 5 is a cross-sectional view taken along lines 5—5 of FIG. 4.
Figure 6:
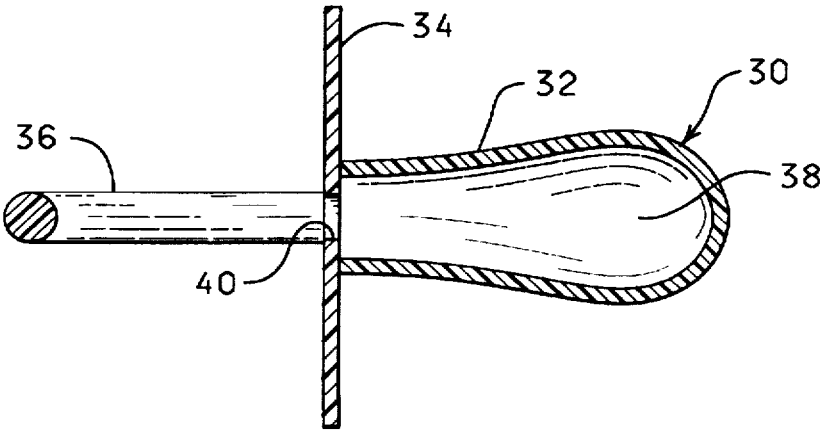
FIG. 6 is a cross-sectional view of the pacifier of the present invention shown with the plug and gel removed.

FIGS. 4–6 illustrate another embodiment of a teething device 30 constructed in accordance with the present invention wherein the teething device 30 is in the form of a pacifier. That is, the teething device 30 includes a nipple-shaped body member 32, a guard portion 34, and a handle 36. The body member 32 is hollow so as to form an interior cavity 38, and the body member 32 is provided with an opening 40 for providing access to the interior cavity 38. Like the body member 12, the body member 32 is formed of a resilient, non-toxic, fluid impervious material, such as a foodgrade plasticized polyvinyl chloride or synthetic rubber, or the like.

The interior cavity 38 is filled with a body of gel 42. The body of gel 42 has the same properties as the body of gel 20 described above and the body of gel 42 is formed in the body member 32 in a manner similar to that described above in reference to the teething device 10. That is, the liquid mixture is injected into the interior cavity 38 of the body member 32 via the opening 40 whereupon the liquid mixture is allowed to set for a period of at least one-half hour, and more preferably for about twenty-four hours. The body of gel 42 is then sealed within the interior cavity 38 by inserting a plasticized plug 44 in the opening 40, and thereafter securing the plug 44 in the opening 40 with a non-toxic adhesive or by sonic welding or the like.

To facilitate an infant holding the teething device 10 when the body member 32 and the body of gel 42 are heated or cooled, the guard portion 34 and the handle 36 are preferably made of a rigid plastic material such that the teething device 10 can be comfortably held by an individual upon heating or cooling the teething device 30.

In use, the teething devices 10 and 30 are heated or cooled to a desired temperature to effect an appropriate thermal treatment. The teething devices 10 and 30 may be heated by immersion in boiling water, for example. In contrast, the teething devices 10 and 30 may be cooled by placing the device in a conventional refrigerator or freezer. When the teething devices 10 and 30 have been heated or cooled to the desired temperature, the teething devices 10 and 30 are ready to be introduced into the mouth of an infant.

It will be appreciated that one of the advantages of the teething devices 10 and 30 is that the pliability of the body members remain substantially constant whether in a heated or cooled condition. As such, an infant may be less likely to refuse the teething device due to a change in the consistency of the device and the teething device can be used to reduce soreness and inflammation, and thus discomfort, to an infant's sore gums.

From the above description it is clear that the present invention is well adapted to carry out the objects and to attain the advantages mentioned herein as well as those inherent in the invention. While presently preferred embodiments of the invention have been described for purposes of this disclosure, it will be understood that numerous changes may be made which will readily suggest themselves to those skilled in the art and which are accomplished within the spirit of the invention disclosed and as defined in the appended claims.

What is claimed is:

1. A teething device, comprising:

a resilient, fluid impervious body member sized to be received in a mouth of an infant, the body member having an interior cavity; and a body of self-sustaining, non-flowable, pliable gel disposed in the interior cavity of the body member such that the body of gel substantially fills the interior cavity, the body of gel characterized by the properties of maintaining the self-sustension and pliability over a temperature range of from about −20° to 215° F. whereby the body member and the body of gel can be heated or cooled over a temperature range of from about −20° to 215° F. without substantially altering the resilience of the body member and the pliability of the body of gel.

2. The teething device of claim 1 wherein the body member is ring shaped.

3. The teething device of claim 2 further comprising a handle constructed of a rigid plastic material and secured to a portion of the body member.

4. The teething device of claim 1 wherein the body member is the shape of a nipple.

5. The teething device of claim 4 further comprising a handle constructed of a rigid plastic material and secured to a portion of the body member.

6. A method of manufacturing a teething device, comprising the steps of:

forming a resilient, fluid impervious body member having an interior cavity and sized to be received in a mouth of an infant;

forming a body of self-sustaining, non-flowable, pliable gel within the interior cavity of the body member such that the body of gel substantially fills the interior cavity, the body of gel being characterized by the properties of maintaining the self-sustension and pliability over a temperature range of from about −20° to 215° F. whereby the body member and the body of gel can be heated or cooled over a temperature range of from about −20° to 215° F. without substantially altering the resilience of the body member and the pliability of the body of gel; and sealing the body of gel within the interior cavity of the body member.

7. A method of administering a thermal treatment within a mouth, comprising the steps of:

providing a resilient, fluid impervious body member sized to be received in the mouth and filled with a body of self-sustaining, non-flowable, pliable gel being characterized by the properties of maintaining the self-sustension and pliability over a temperature range of from about −20° to 215° F. whereby the body member and the body of gel can be heated or cooled over a temperature range of from about −20° to 215° F. without substantially altering the resilience of the body member and the pliability of the body of gel;

treating the body member and the body of gel by altering the temperature of the body member and the body of gel to a level significantly above or below body temperature while maintaining the pliability of the body member and the body of gel; and introducing the body member into the mouth and applying the body member and placing the body member in close proximity to a selected portion of the mouth for heating or cooling of the selected portion.

* * * * *